US006231236B1

(12) United States Patent
Tilman

(10) Patent No.: US 6,231,236 B1
(45) Date of Patent: May 15, 2001

(54) RESEALABLE PACKAGE HAVING VENTING STRUCTURE AND METHODS

(75) Inventor: Paul A. Tilman, Sherwood, WI (US)

(73) Assignee: Reynolds Consumer Products, Inc., Richmond, VA (US)

( * ) Notice: Subject to any disclaimer, the term of this patent is extended or adjusted under 35 U.S.C. 154(b) by 0 days.

(21) Appl. No.: 09/351,468

(22) Filed: Jul. 12, 1999

Related U.S. Application Data

(60) Provisional application No. 60/094,432, filed on Jul. 28, 1998.

(51) Int. Cl.[7] ..... B65D 33/16; B65D 33/01

(52) U.S. Cl. ..... 383/63; 383/61; 383/103

(58) Field of Search ..... 383/61, 63, 100, 383/103; 206/524.8

(56) References Cited

U.S. PATENT DOCUMENTS

| | | | |
|---|---|---|---|
| 2,361,344 | 10/1944 | Yates . | |
| 3,172,443 | 3/1965 | Ausnit . | |
| 3,237,844 | 3/1966 | Hughes . | |
| 3,637,132 | 1/1972 | Gray . | |
| 3,937,396 | 2/1976 | Schneider . | |
| 4,240,241 | 12/1980 | Sanborn, Jr. . | |
| 4,284,228 | 8/1981 | Cetrelli . | |
| 4,532,652 | 7/1985 | Herrington . | |
| 4,969,309 | 11/1990 | Schwarz et al. . | |
| 5,038,547 | 8/1991 | Kai et al. . | |
| 5,400,568 | 3/1995 | Kanemitsu et al. . | |
| 5,403,094 | 4/1995 | Tomic . | |
| 5,511,884 | 4/1996 | Bruno et al. . | |
| 5,540,500 * | 7/1996 | Tanaka | 383/100 X |
| 5,544,752 | 8/1996 | Cox . | |
| 5,839,582 * | 11/1998 | Strong et al. | 383/63 X |

FOREIGN PATENT DOCUMENTS

| | | | |
|---|---|---|---|
| 0212355 * | 9/1991 | (JP) | 383/103 |
| 406099991 * | 4/1994 | (JP) | 383/63 |
| 406227551 * | 8/1994 | (JP) | 383/100 |
| WO 97/42090 | 11/1997 | (WO) . | |

* cited by examiner

*Primary Examiner*—Jes F. Pascua

(57) ABSTRACT

A flexible package includes first and second opposed panel sections, first and second resealable closure mechanisms, and a venting structure. The first and second panel sections define a first package end and a second package end. The second package end is open. The first and second closure mechanisms have an open and a closed configuration. The first closure mechanism is operably positioned to selectively interlock and close the second package end. The first closure mechanism and the first and second panel sections define a storage interior. The second closure mechanism is also operably positioned to selectively interlock and close the second package end. The second closure mechanism is positioned between the first closure mechanism and the second package end. The venting structure defines a gas-flow passageway between the storage interior and an exterior environment. The venting structure is constructed and arranged to permit gas-flow between the storage interior and the exterior environment when the first closure mechanism is in the closed configuration and the second closure mechanism is in the open configuration. The venting structure and the second closure mechanism are positioned to inhibit gas-flow between the storage interior and the exterior environment when the second closure mechanism is in the closed configuration.

17 Claims, 3 Drawing Sheets

RESEALABLE PACKAGE HAVING VENTING STRUCTURE AND METHODS

CLAIM TO PRIORITY UNDER 35 U.S.C. § 119 (e)

Priority under 35 U.S.C. § 119 (e) is requested to Provisional Application Ser. No. 60/094,432, filed on Jul. 28, 1998, and entitled RECLOSABLE BAG WITH VENTING STRUCTURE. The complete disclosure is incorporated by reference herein.

FIELD OF THE INVENTION

The present invention generally relates to closure arrangements for polymer packages, such as plastic bags. In particular, the present invention relates to resealable packages having a venting structure and methods of manufacture and use.

BACKGROUND

Resealable containers store or enclose various types of articles and materials. These packages can be used to store a variety of products, for example food items and non-food consumer goods. Resealable packages are convenient in that they can be closed and resealed after the initial opening to preserve the enclosed contents. In some instances, providing products in resealable packages appreciably enhances the marketability of those products.

Many packages entrap gases, such as air, when sealed. This can be, in certain instances, problematic because the gases can promote decay and subsequent degradation of the product; therefore, at least partial exhaustion of gases is desirable.

SUMMARY OF THE DISCLOSURE

In one aspect of the present disclosure, an example embodiment involves a flexible package. The flexible package includes first and second opposed panel sections, first and second resealable closure mechanisms, and a venting structure. The first and second panel sections define a first package end and a second package end. The second package end is open. The first and second closure mechanisms have an open and a closed configuration. The first closure mechanism is operably positioned to selectively interlock and close the second package end. The first closure mechanism and the first and second panel sections define a storage interior. The second closure mechanism is also operably positioned to selectively interlock and close the second package end. The second closure mechanism is positioned between the first closure mechanism and the second package end.

The venting structure defines a gas-flow passageway between the storage interior and an exterior environment. The venting structure is configured, constructed, and arranged to permit gas-flow between the storage interior and the exterior environment when the first closure mechanism is in the closed configuration and the second closure mechanism is in the open configuration. The venting structure and the second closure mechanism are positioned to inhibit gas-flow between the storage interior and the exterior environment when the second closure mechanism is in the closed configuration.

In another aspect of the present disclosure, a flexible package includes first and second opposed panel sections and first and second resealable closure mechanisms. The first and second panel sections define a first package end and a second package end. The second package end is open. The first and second closure mechanisms have an open and a closed configuration. The first closure mechanism is operably positioned to selectively interlock and close the second package end. The second closure mechanism is also operably positioned to selectively interlock and close the second package end. The second closure mechanism is positioned between the first closure mechanism and the second package end. At least the first panel section defines an aperture having a cross-sectional area greater than 0.004 square inches, and the aperture is positioned between the second closure mechanism and the second package end.

In another aspect of the present disclosure, a flexible package includes first and second opposed panel sections and a resealable closure mechanism. The first and second panel sections define a first package end and a second package end. The second package end is open. The closure mechanism is operably positioned to selectively interlock and close the second package end and has an open and a closed configuration. The first panel section and the closure mechanism define an aperture having a cross-sectional area greater than 0.004 square inches.

In another aspect, a method of constructing a closure arrangement is described. The method includes placing a first panel section having first and second interlocking members opposite a second panel section having third and fourth interlocking members, sealing first and second edges of the first panel section to respective first and second edges of the second panel section to create a package interior; and punching an aperture through the first and second panel sections and through the first resealable closure mechanism.

In another aspect, a method of using a flexible package having opposite first and second panel sections defining an interior, first and second resealable closure mechanisms disposed between the first and second panel sections, and a venting structure is described. The method includes engaging the first resealable closure mechanism; pressing the first and second panel sections from a first end farthest from the venting structure progressively toward the venting structure to cause gases to be exhausted from the interior through the venting structure; and engaging the second resealable closure mechanism to seal the interior.

DETAILED DESCRIPTION

The principles described herein are applicable to a variety of packaging arrangements. The principles of the disclosure are particularly advantageous for manufacturing resealable packages. An appreciation of various aspects can be gained from the following discussion of an application example for such a packaging arrangement.

A. Overview of the Package 10

Figure 1:
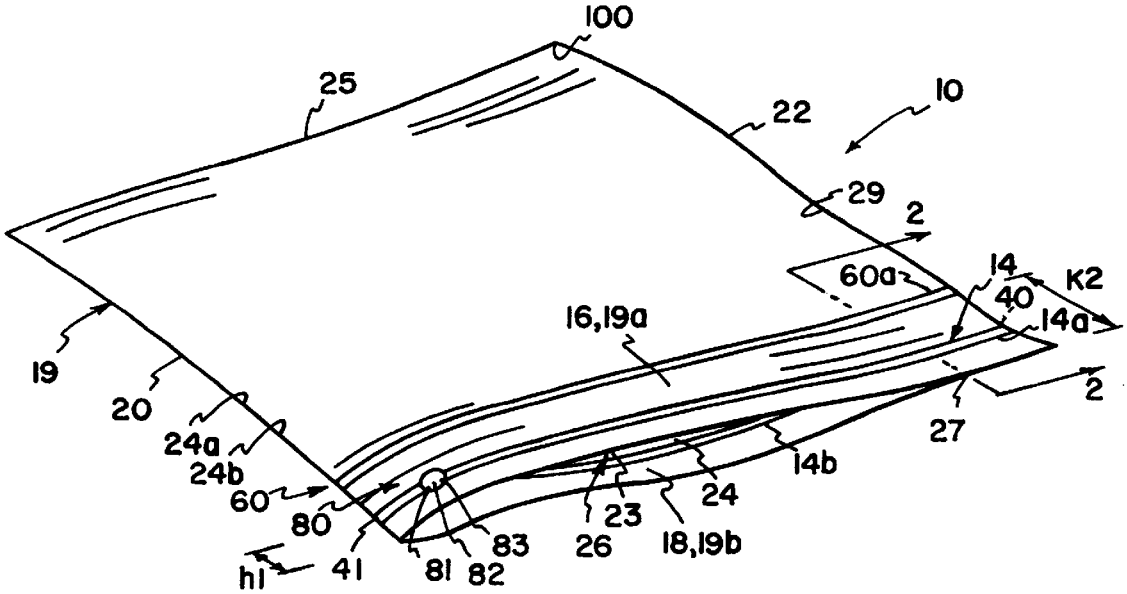
FIG. 1 is a schematic, perspective view of an example embodiment of a flexible, resealable package, according to selected principles of the present disclosure.

Attention is directed to FIG. 1. FIG. 1 is a schematic, perspective view illustrating an example packaging or closure arrangement in the form of a resealable, flexible package 10, for example, a polymeric package such as a plastic bag, having a first resealable closure mechanism 14 comprising interlocking profiled elements 14*a*, 14*b*, and a second resealable closure mechanism 60 also comprising interlocking profile elements 60*a*, 60*b* (viewable in FIG. 4) constructed in accordance with the present disclosure.

The flexible package 10 includes first and second opposed panel sections 16, 18, typically made from a flexible, polymeric, plastic film, such as low density polyethylene, commonly known. Alternatively, the panel sections 16, 18 can be made from multilayer laminates, metalized plastic, or other materials having some flexibility.

With some manufacturing applications, a single sheet of film 19 is folded along a first closed edge 25 to create the first and second panel sections 16, 18. The panel sections 16, 18 are heat-sealed or ultrasonically crushed along first and second side edges 20, 22. Alternatively, two separate sheets of film 19*a*, 19*b*, corresponding to the first and second panel sections 16, 18, respectively, can be heat-sealed or ultrasonically crushed along the two side edges 20, 22 and at an unsealed edge 23. In some applications, the unsealed edge 23 can be sealed at a later time. In other alternative embodiments, the package 10 can also have bottom or side-gussets.

In the particular embodiment illustrated in FIG. 1, the first resealable closure mechanism 14 is positioned between the first closed edge 25 and the first open edge 27. The second resealable closure mechanism 60 is positioned between the first closed edge 25 and the first resealable closure mechanism 14. Preferably, the first resealable closure mechanism 14 is positioned between the first and second panel sections 16, 18 a first distance K1 from a first open edge 27. The second resealable closure mechanism 60 is disposed between the first and second panel sections 16, 18 a second distance K2 from the first open edge 27 greater than the first distance K1.

The resealable package 10 includes a venting structure 80. The venting structure 80 is described in more detail below in conjunction with FIG. 4.

A region 24*a*, defined by the side edges 20, 22, the first closed edge 25, and the open edge 27, defines a package interior 24. A region 24*b*, defined by the side edges 20, 22, the first closed edge 25, and the second resealable closure mechanism 60, defines a product interior 29 where product is stored. Access is provided to the interiors 24, 29 through a mouth 26 at the first open edge 27 of the package 10. In the particular embodiment illustrated in FIG. 1, the mouth 26 extends the width of the package 10.

B. The First Resealable Closure Mechanism 14

Figure 2:
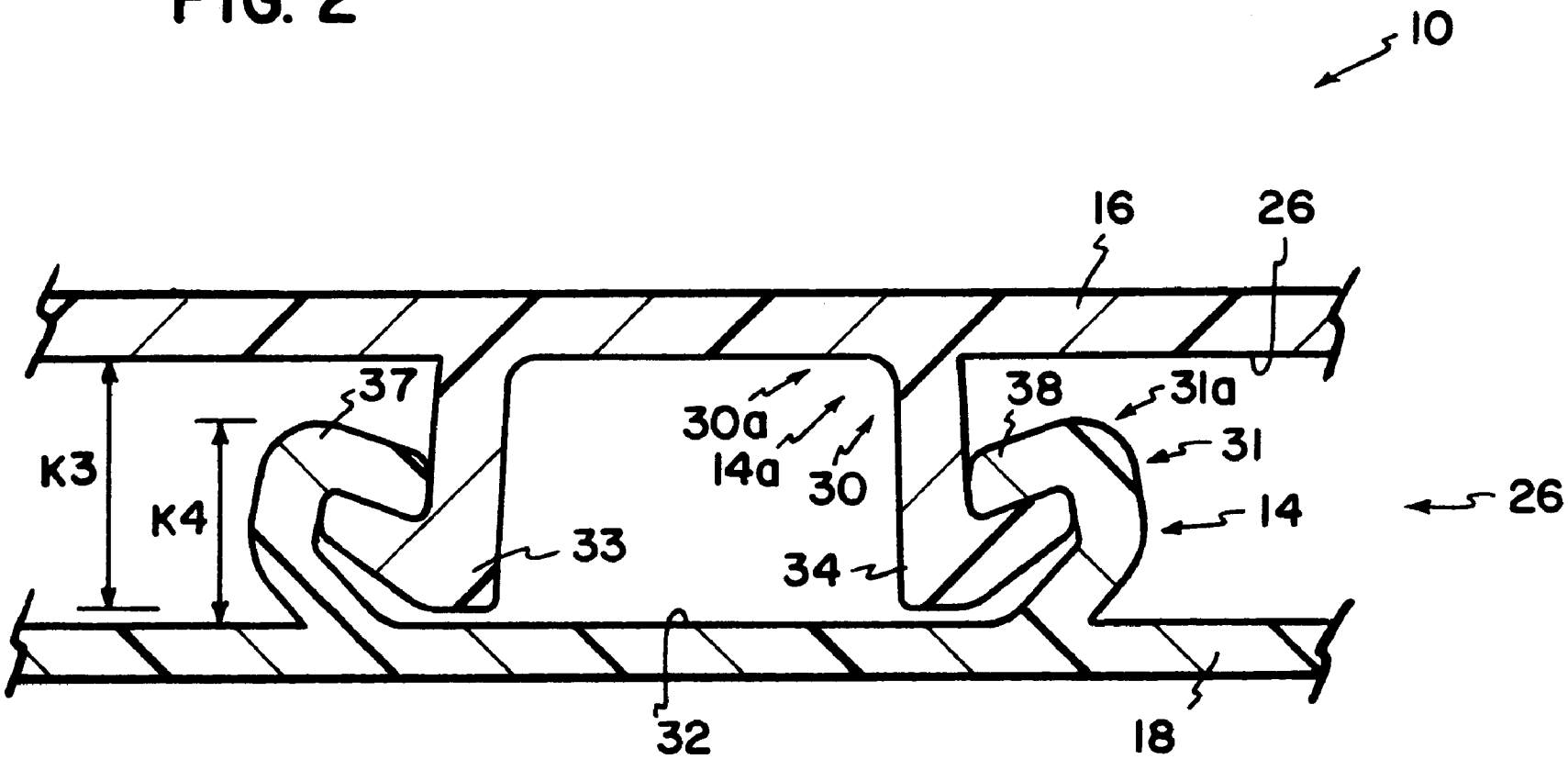
FIG. 2 is an enlarged, fragmentary, cross-sectional view taken along the line 2—2 of FIG. 1.

Attention is directed to FIG. 2. FIG. 2 is a fragmentary, cross-sectional view of the first resealable closure mechanism 14 of the flexible package 10. The first resealable closure mechanism 14 is illustrated at the mouth 26 of the flexible package 10. Alternatively, the closure mechanism 14 could be positioned on the package 10 at a location different from the mouth 26 of the package 10, depending on the application needs for the package 10.

The first resealable closure mechanism 14 can be one of a variety of closure mechanisms. In the particular embodiment illustrated in FIG. 2, the first resealable closure mechanism 14 is shown in the specific form of a zipper-type closure mechanism. By the term "zipper-type closure mechanism," it is meant a structure having opposite interlocking or mating profiled elements 14*a*, 14*b* that under the application of pressure will interlock and close a region 32 between the profiled elements 14*a*, 14*b*.

Figure 3:
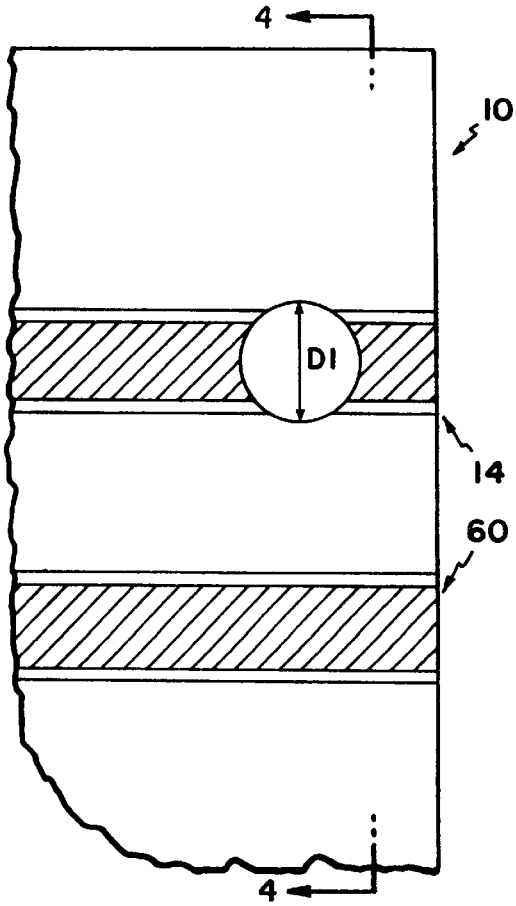
FIG. 3 is an enlarged, fragmentary, plan view of the resealable package of FIG. 1.
Figure 4:
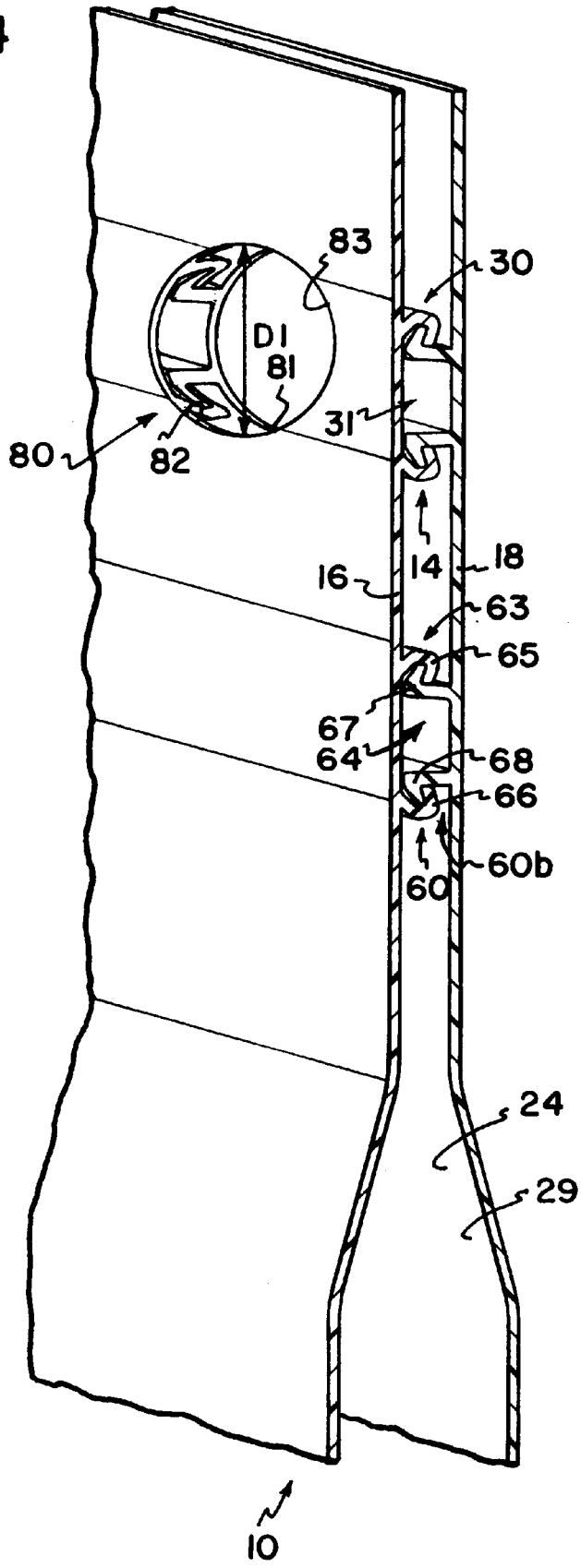
FIG. 4 is a schematic, fragmentary, cross-sectional view taken along the line 4—4 of FIG. 3.

In the embodiment illustrated in FIGS. 2–4, the closure mechanism 14 is a multi-track closure mechanism and includes a first closure profile 30 and a second closure profile 31. By the term "multi-track," it is meant two or more pairs of interengaging hooks 30*a*, 31*a*. In FIG. 2, the first and second closure profiles 30, 31 are shown in a closed configuration. By the term "closed," it is meant that the first and second closure profiles 30, 31 are generally interlocked and that the package is substantially sealed. By the term "sealed," it is meant that generally, the resealable closure mechanism 14 prevents gases from flowing into or out of the package interior 24. By the term "substantially," it is meant that the resealable closure mechanism 14 does not create a perfect seal due to imperfections in the resealable closure mechanism 14. In general, "substantially sealed" means that the package interior 24 is not significantly exhausted under small amounts of hand pressure.

Referring to FIG. 1, the resealable closure mechanism 14 also has an open configuration. By the term "open," it is meant that the first and second closure profiles 30, 31 are at least partially not interlocked, and that the package is not substantially sealed. "Partially closed" or "open" means that the resealable closure mechanism 14 is in an open configuration. In the open configuration, the package interior 24 is in gas-flow communication with an exterior environment. By the term "exterior environment," it is meant the atmosphere outside of the first and second panel sections 16, 18 and the first resealable closure mechanism 14.

The first closure profile 30 includes first and second interlocking closure members 33, 34. The first and second interlocking closure members 33,34 extend from the first panel section 16 of the package 10 of FIG. 1, and are generally projecting from the first panel section 16 toward the second panel section 18 of FIG. 1. The second closure profile 31 likewise includes first and second interlocking closure members 37, 38. The first and second interlocking closure members 37, 38 extend from the second panel section 18 and are generally projecting from the second panel section 18 toward the first panel section 16.

In FIG. 2, the resealable closure mechanism 14 is operably positioned. By the term "operably positioned," it is meant that the first and second closure profiles 30, 31 are configured and constructed (or constructed and arranged) to engage with one another to form the resealable closure mechanism 14. The first interlocking closure member 33 of the first closure profile 30 extends from the first panel section 16 a third distance K3. The first interlocking closure member 37 of the second closure profile 31 extends from the second panel section 18 a fourth distance K4. These distances K3, K4 that the first interlocking closure members 33, 37, respectively, extend are sufficient to allow mechanical engagement between the first interlocking closure member 33 of the first closure profile 30 and the first interlocking closure member 37 of the second closure profile 31.

Analogously, the second interlocking closure member 34 of the first closure profile 30 and the second interlocking closure member 38 of the second closure profile 31 mechanically engage with each other. The second interlocking closure member 34 of the first closure profile 30 extends from the first panel section 16 the third distance D3. The second interlocking closure member 38 of the second closure profile 31 extends from the second panel section 18 the fourth distance D4. These distances D3, D4 that the second interlocking closure members 34, 38 extend are sufficient to allow mechanical engagement between the second interlocking closure member 34 of the first closure profile 30 and the second interlocking closure member 38 of the second closure profile 31.

Referring back to FIG. 1, the first closure profile 30 (FIG. 2) has first and second opposite ends 40, 41. Likewise, although not shown, the second closure profile 31 (FIG. 2) has first and second opposite ends. The first opposite end 40 of the first closure profile 30 and the first opposite end (not shown) of the second closure profile 31 are sealed together at the second side edge 22 of the package 10. Analogously, the second opposite end 41 of the first closure profile 30 and the second opposite end (not shown) of the second closure profile 31 are sealed together at the first side edge 20 of the package 10.

Sealing the closure profiles 30, 31 (FIG. 2) together at the side edges 20, 22 of the package 10 aids in aligning the closure profiles 30, 31 for interlocking. Preferably, pressure is applied to the closure profiles 30, 31 as they engage and form an openable sealed closure mechanism 14. Pulling the first closure profile 30 and the second closure profile 31 away from each other causes the two closure profiles 30, 31 to disengage, opening the package 10. This provides access to the contents of the package 10 through the mouth 26.

Referring back to FIG. 2, in the particular embodiment illustrated, the closure profiles 30, 31 are shown integral with the first and second panel sections 16, 18, respectively, of the package 10 of FIG. 1. Preferably, the closure profiles 30, 31 are extruded with the panel sections 16, 18, respectively of the package 10 of FIG. 1. Of course, in an alternative embodiment not shown, closure profiles can be formed by two separate extrusions or through two separate openings of a common extrusion. In this alternative embodiment, the closure profiles would typically include base strips for attaching the closure profiles to a package.

Typically, the resealable closure mechanism 14 is made of a polymer, plastic material, such as polyethylene or polypropylene. In one example embodiment, the resealable closure mechanism 14 illustrated in FIG. 2 is manufactured using conventional extrusion and heat sealing techniques.

In another alternative embodiments, the resealable closure mechanism can be any simple or complex closure mechanism, commonly known.

C. The Second Resealable Closure Mechanism 60

Attention is directed to FIG. 3. FIG. 3 is an enlarged, fragmentary, plan view of the resealable package 10. In the particular embodiment illustrated, the package 10 preferably includes the second resealable closure mechanism 60. Attention is directed to FIG. 4. FIG. 4 is a schematic, cross-sectional, perspective view of the flexible package 10.

Preferably, the second resealable closure mechanism 60 has structure analogous to the first resealable closure mechanism 14 including first and second closure profiles 63, 64. As such, the first closure profile 63 includes first and second interlocking closure members 65, 66 and the second closure profile 64 includes third and fourth interlocking closure members 67, 68.

D. The Venting Structure 80

Still referring to FIG. 4, preferably, the package 10 also includes the venting structure 80. Herein the term "venting structure" is meant to refer to structure that permits gases, such as air, to be exhausted from the storage interior 29 even when the first resealable closure mechanism 14 is in a closed configuration, provided the second resealable closure mechanism 60 is in the open configuration. Generally, the venting structure 80 comprises structure that defines a gas-flow passageway 81.

In the particular embodiment illustrated in FIG. 4, the gas-flow passageway 81 comprises a vent 82. Generally, the vent 82: will extend through at least the first panel section 16; is located between the second resealable closure mechanism 60 and the first resealable closure mechanism 14; and can extend through the first resealable closure mechanism 14. Preferably, the vent 82 extends between the first panel section 16 and the second panel section 18 and extends completely therethrough, including through the first resealable closure mechanism 14. In an alternative embodiment, the vent 82 can pass through only one of the first and second panel sections 16, 18 and is located between the first and second resealable closure mechanisms 14, 60. In another alternative embodiment, the vent 82 can pass through both first and second panel sections 16, 18 and is located between the first and second resealable closure mechanisms 14, 60. In yet another alternative embodiment, the vent 82 can pass through one of the first and second panel sections 16, 18 and the first resealable closure mechanism 14. In yet another alternative embodiment, the vent 82 can pass through only the first resealable closure mechanism 14.

As will be apparent from the drawings and the principles described herein, a variety of configurations will be suitable, for example, the gas-flow passageway 81 can be various sizes and shapes that allow exhausting of gases within an appropriate time period. Preferably, the vent 82 has a cross-sectional area of at least 0.004 square inches (about 0.03 sq. cm), and typically has a cross-sectional area of 0.03 square inches (about 0.2 sq. cm). In the particular embodiment illustrated in FIG. 4, the vent 82 comprises a venting aperture or hole 83 having a circular cross-section with a first diameter D1. Preferably, the venting hole 83 is created by punching a hole through the package 10 in the region of the first resealable closure mechanism 14. Preferably, the first diameter D1 is between 1/16 inch (about 2 mm) and 1/2 inch (about 13 mm), most preferably between 1/8 inch (about 3 mm) and 3/8 inches (about 10 mm), and typically being 3/16 inches (about 5 mm). Of course, other shapes and configurations can be used, for example, a rectangular vent or an oblong vent.

The vent 82 can be located at any location on the package 10 between the first and second resealable closure mechanisms 14, 60 or at any location along the first resealable closure mechanism 14. In the particular embodiment illustrated in FIG. 4, the vent 82 is located along the first resealable closure mechanism 14. In particular, the vent 82 is centered on the first resealable closure mechanism 14 such that a first portion 84 extends below the first resealable closure mechanism 14 and a second portion 85 extends above the first resealable closure mechanism 14. This arrangement permits gases to be exhausted from the interior of the package 10 through the vent 82.

Referring back to FIG. 3, the vent 82 can be located any distance from the side edges 20, 22 of the package 10. In the particular embodiment illustrated in FIG. 1, the vent 82 is located at least 1/16 inch (about 2 mm) from the first side edge 20 and at least 1/16 inches (about 2 mm) from the second side edge 22.

In the embodiment illustrated in FIG. 4, the venting hole 82 is arranged and configured to create the gas-flow passageway 81 through the first resealable closure mechanism 14. The gas-flow passageway 81 of the venting structure 80 is in gas-flow communication with the storage interior 29 of the package 10. The passageway 81 allows gases, such as air, to be at least partially expelled from the storage interior 29 of the package 10 through the venting hole 82.

E. Methods of Operation

Referring back to FIG. 1, during use, a user of the package 10 places a product (not shown) in the storage interior 29 of the package 10 through the mouth 26. After placing the product in the package 10, the user closes the first resealable closure mechanism 14 by applying pressure across the first and second closure profiles 30, 31 (FIG. 4), causing the first and second closure profiles 30, 31 to mateably engage. The venting hole 82 leaves a gas-flow passageway 81 through the first resealable closure mechanism 14. The first and second panel sections 16, 18 of the package 10 are progressively pressed together starting from a farthest region 100 of the package 10 from the venting hole 82 to the venting hole 82. Gases in the package 10 are progressively exhausted through the venting hole 82 as the first and second panel sections 16, 18 are progressively pressed together. When the gasses are sufficiently exhausted, the user closes the second resealable closure mechanism 60 to seal the storage interior 29 of the package 10 by applying pressure across the first and second closure profile 63, 64. To open the package 10, the user pulls the first panel section 16 away from the second panel section 18, causing the first and second resealable closure mechanisms 14, 60 to disengage.

The above specification and examples are believed to provide a complete description of the manufacture and use of particular embodiments of the invention. Many embodiments of the invention can be made without departing from the spirit and scope of the invention.

What is claimed is:

1. A flexible package comprising:

(a) first and second opposed panel sections;

(i) said first and second opposed panel sections defining a first package end and a second package end, wherein the second package end is open and the first package end is closed;

(b) a first resealable closure mechanism;

(i) said first closure mechanism being operably positioned to selectively interlock and close said second package end, and having an open configuration and a closed configuration;

(ii) said first closure mechanism and said first and second panel sections defining a storage interior;

(c) a second resealable closure mechanism;

(i) said second closure mechanism being operably positioned to selectively interlock and close said second package end, and having an open configuration and a closed configuration;

(ii) said second closure mechanism being positioned between the first closure mechanism and the first package end;

(d) a venting structure oriented in said first closure mechanism; said first panel section defining an aperture comprising said venting structure;

(i) said venting structure defining a gas-flow passageway between said storage interior and an exterior environment;

(A) said venting structure being configured and constructed to permit gas-flow between said storage interior and the exterior environment, when said first closure mechanism is in the closed configuration and said second closure mechanism is in the open configuration; and (B) said venting structure and said second closure mechanism being positioned to inhibit gas-flow between said storage interior and the exterior environment, when said second closure mechanism is in the closed configuration.

2. A flexible package according to claim 1, wherein:

(a) said first closure mechanism is positioned a first distance from said second package end and toward said first package end;

(b) said second closure mechanism is positioned a second distance from said second package end and toward said first package end; and (c) said second distance is greater than said first distance.

3. A flexible package according to claim 1, wherein:

(a) said aperture has a cross-sectional area of at least 0.004 square inches.

4. A flexible package according to claim 3, wherein:

(a) said aperture has a circular cross-sectional area.

5. A flexible package according to claim 4, wherein:

(a) said aperture has a diameter of at least 1/16 inches.

6. A flexible package according to claim 1, wherein:

(a) said first and second closure mechanisms are integral with said first and second panel sections.

7. A flexible package according to claim 1, wherein:

(a) said first closure mechanism comprises first and second closure profiles;

(i) said first and second closure profiles being configured and constructed to selectively interlock;

(b) said second closure mechanism comprises third and fourth closure profiles; and (i) said third and fourth closure profiles being configured and constructed to selectively interlock.

8. A flexible package according to claim 7, wherein:

(a) said first closure profile includes first and second interlocking members, and said second closure profile includes third and fourth interlocking members;

(i) said first interlocking member being configured and constructed to selectively interlock with said third interlocking member, and said second interlocking member being configured and constructed to selectively interlock with said fourth interlocking member;

(b) said third closure profile includes fifth and sixth interlocking members, and said fourth closure profile includes seventh and eighth interlocking members; and (i) said fifth interlocking member being configured and constructed to selectively interlock with said seventh interlocking member, and said sixth interlocking member being configured and constructed to selectively interlock with said eighth interlocking member.

9. A flexible package comprising:

(a) first and second opposed panel sections;

(i) said first and second opposed panel sections defining a first package end and a second package end, wherein the second package end is open and the first package end is closed;

(b) a first resealable closure mechanism;

(i) said first closure mechanism being operably positioned to selectively interlock and close said second package end, and having an open configuration and a closed configuration;

(c) a second resealable closure mechanism;

(i) said second closure mechanism being operably positioned to selectively interlock and close said second package end, and having an open configuration and a closed configuration;

(ii) said second closure mechanism being positioned between the first closure mechanism and the first package end; and (d) wherein at least said first panel section defines an aperture having a cross-sectional area greater than 0.004 square inches and said aperture is positioned through the first closure mechanism; said second closure mechanism being free from passage of said aperture therethrough.

10. A flexible package according to claim 9 wherein:

(a) said first panel section and said first closure mechanism define said aperture.

11. A flexible package according to claim 10, wherein:

(a) said first and second panel sections and said first closure mechanism define said aperture.

12. A flexible package according to claim 9, wherein:

(a) said aperture has a circular cross-sectional area.

13. A flexible package according to claim 12 wherein:

(a) said aperture has a diameter of at least 1/16 inches.

14. A flexible package comprising:

(a) first and second opposed panel sections;

(i) said first and second opposed panel sections defining a first package end and a second package end, wherein the second package end is open and the first package end is closed;

(b) a first resealable closure mechanism;

(i) said first closure mechanism being operably positioned to selectively interlock and close said second package end, and having an open configuration and a closed configuration;

(ii) said first closure mechanism and said first and second panel sections defining a storage interior;

(iii) said first closure mechanism comprises first and second closure profiles;

(A) said first and second closure profiles being configured and constructed to selectively interlock;

(c) a second resealable closure mechanism;

(i) said second closure mechanism being operably positioned to selectively interlock and close said second package end, and having an open configuration and a closed configuration;

(ii) said second closure mechanism being positioned between the first closure mechanism and the first package end;

(iii) said second closure mechanism comprises third and fourth closure profiles;

(A) said third and fourth closure profiles being configured and constructed to selectively interlock;

(d) a venting structure oriented in said first closure mechanism; said venting structure comprising an aperture extending through said first and second closure profiles;

(i) said venting structure defining a gas-flow passageway between said storage interior and an exterior environment;

(A) said venting structure being configured and constructed to permit gas-flow between said storage interior and the exterior environment, when said first closure mechanism is in the closed configuration and said second closure mechanism is in the open configuration;

(B) said venting structure and said second closure mechanism being positioned to inhibit gas-flow between said storage interior and the exterior environment, when said second closure mechanism is in the closed configuration.

15. A flexible package according to claim 14 wherein:

(a) said aperture extends through both said first panel section and said second panel section.

16. A flexible package comprising:

(a) first and second opposed panel sections;

(i) said first and second opposed panel sections defining a first package end and a second package end, wherein the second package end is open and the first package end is closed;

(b) a first resealable closure mechanism;

(i) said first closure mechanism being operably positioned to selectively interlock and close said second package end, and having an open configuration and a closed configuration;

(ii) said first closure mechanism and said first and second panel sections defining a storage interior;

(iii) said first closure mechanism comprises first and second closure profiles;

(A) said first and second closure profiles being configured and constructed to selectively interlock;

(c) a second resealable closure mechanism;

(i) said second closure mechanism being operably positioned to selectively interlock and close said second package end, and having an open configuration and a closed configuration;

(ii) said second closure mechanism being positioned between the first closure mechanism and the first package end;

(iii) said second closure mechanism comprises third and fourth closure profiles;

(A) said third and fourth closure profiles being configured and constructed to selectively interlock;

(iv) said first closure profile includes first and second interlocking members, and said second closure profile includes third and fourth interlocking members;

(A) said first interlocking member being configured and constructed to selectively interlock with said third interlocking member, and said second interlocking member being configured and constructed to selectively interlock with said fourth interlocking member;

(v) said third closure profile includes fifth and sixth interlocking members, and said fourth closure profile includes seventh and eighth interlocking members;

(A) said fifth interlocking member being configured and constructed to selectively interlock with said seventh interlocking member, and said sixth interlocking member being configured and constructed to selectively interlock with said eighth interlocking member;

(d) a venting structure oriented in said first closure mechanism; said venting structure comprising an aperture extending through said first and second interlocking members and through said third and fourth interlocking members;

(i) said venting structure defining a gas-flow passageway between said storage interior and an exterior environment;

(A) said venting structure being configured and constructed to permit gas-flow between said storage interior and the exterior environment, when said first closure mechanism is in the closed configuration and said second closure mechanism is in the open configuration;

(B) said venting structure and said second closure mechanism being positioned to inhibit gas-flow between said storage interior and the exterior environment, when said second closure mechanism is in the closed configuration.

17. A flexible package according to claim 16 wherein:

(a) said aperture extends through both said first panel section and said second panel section.

* * * * *